US010864133B2

(12) United States Patent
Soucy et al.

(10) Patent No.: US 10,864,133 B2
(45) Date of Patent: Dec. 15, 2020

(54) EXOSKELETON STRUCTURE THAT PROVIDES FORCE ASSISTANCE TO THE USER

(71) Applicants: SAFRAN ELECTRONICS & DEFENSE, Boulogne-Billancourt (FR); B-TEMIA INC., Quebec (CA)

(72) Inventors: Francisco Soucy, Quebec (CA); Katia Bilodeau, Quebec (CA); Nathaniel Zoso, Quebec (CA); Jonathan Baptista, Boulogne-Billancourt (FR); Jordane Grenier, Boulogne-Billancourt (FR)

(73) Assignees: SAFRAN ELECTRONICS & DEFENSE, Boulogne-Billancourt (FR); B-TEMIA INC., Quebec (CA)

( * ) Notice: Subject to any disclaimer, the term of this patent is extended or adjusted under 35 U.S.C. 154(b) by 0 days.

(21) Appl. No.: 16/320,792

(22) PCT Filed: Jul. 28, 2017

(86) PCT No.: PCT/EP2017/069228
§ 371 (c)(1),
(2) Date: Jan. 25, 2019

(87) PCT Pub. No.: WO2018/020032
PCT Pub. Date: Feb. 1, 2018

(65) Prior Publication Data

US 2019/0336385 A1 Nov. 7, 2019

(30) Foreign Application Priority Data

Jul. 28, 2016 (FR) ..... 16 57295

(51) Int. Cl.
*A61H 3/00* (2006.01)
*A61H 1/02* (2006.01)

(52) U.S. Cl.
CPC ..... *A61H 3/008* (2013.01); *A61H 1/0262* (2013.01); *A61H 1/024* (2013.01); *A61H 1/0244* (2013.01); *A61H 2201/165* (2013.01)

(58) Field of Classification Search
CPC .... A61H 1/024; A61H 1/0244; A61H 1/0262; A61H 1/0266; A61H 3/00; A61H 3/008;
(Continued)

(56) References Cited

U.S. PATENT DOCUMENTS 3,826,251 A 7/1974 Ross
4,323,059 A * 4/1982 Rambert ..... A61F 13/041 602/16

(Continued)

FOREIGN PATENT DOCUMENTS

EP 0 361 405 A2 4/1990
EP 0361405 A3 4/1990

(Continued)

OTHER PUBLICATIONS

Preliminary Research Report dated Mar. 14, 2017, from the National Institute of Industrial Property in counterpart Application No. FR 1657295.

(Continued)

*Primary Examiner* — Kari K Rodriguez
*Assistant Examiner* — Brant T Bennett
(74) *Attorney, Agent, or Firm* — Sughrue Mion, PLLC

(57) ABSTRACT

An exoskeleton subassembly is provided. The exoskeleton subassembly includes first and second exoskeleton parts, and a connecting assembly that connects the first and second exoskeleton parts. The connecting assembly includes a guide, a pin, and a limiting device. The guide is fixedly mounted on one part, and a pin fixedly mounted on the other part and slidably mounted inside the guide. The limiting device allows rotation of the pin with respect to the guide
(Continued)

Figure 1:
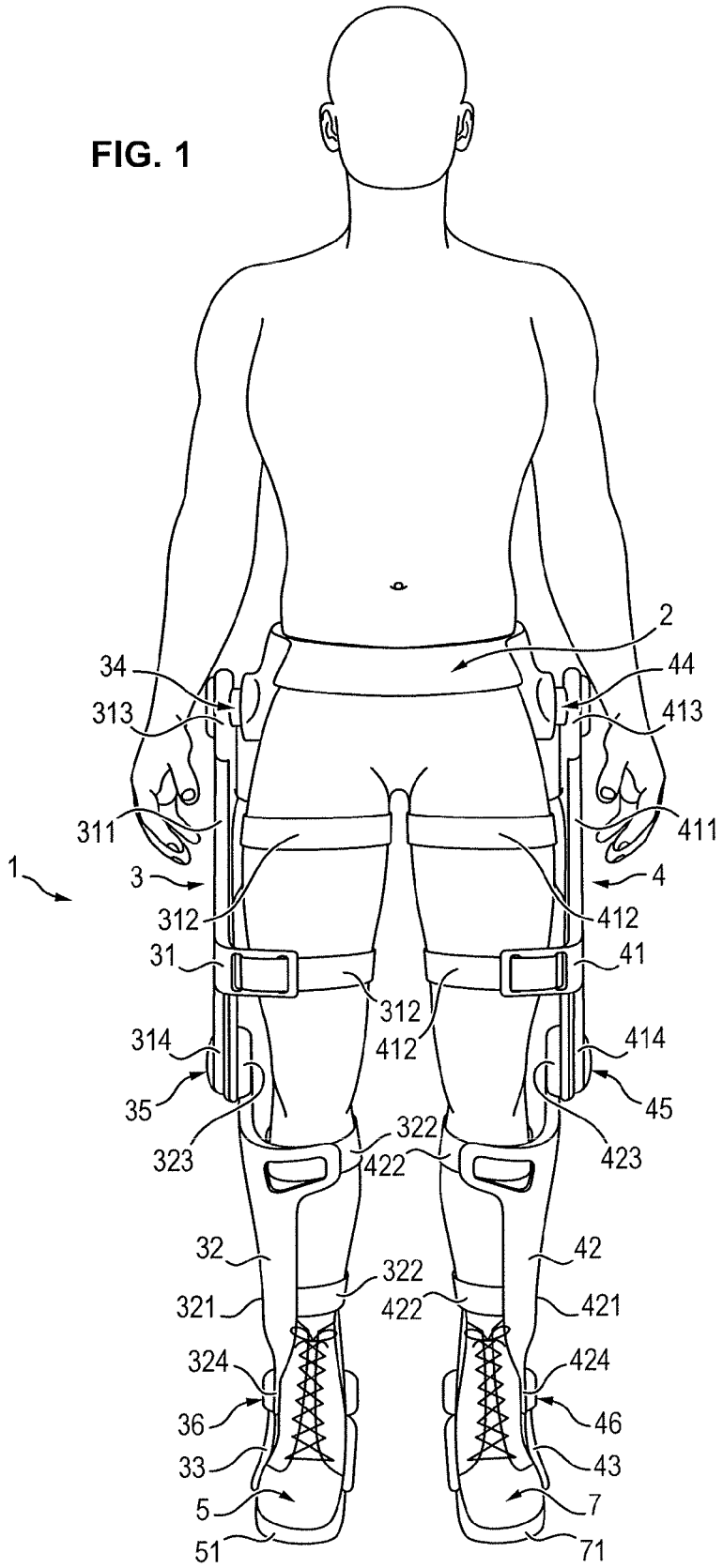

when the pin is in a first position, and to oppose the rotation when the pin is in a second position. The limiting device includes an elastic element engaged with the first part when the pin is in the second position. The elastic element exerts on the first part an elastic return force opposing relative rotation between the first and second parts both in two opposite directions of rotation.

15 Claims, 6 Drawing Sheets

(58) Field of Classification Search
CPC ..... A61H 2003/007; A61H 2201/164; A61H 2201/1642; A61H 2205/106; A61H 2205/12; A61F 5/01; A61F 5/0111; A61F 5/0113; A61F 5/0127; A61F 5/013; A61F 5/0195; A61F 2005/0102; A61F 2005/0123; A61F 2005/0125; A61F 2005/0132; A61F 2005/0134; A61F 2005/0137; A61F 2005/0139; A61F 2005/0141; A61F 2005/0144; A61F 2005/0146; A61F 2005/0148; A61F 2005/0153; A61F 2005/0155; A61F 2005/0158; A61F 2005/016; A61F 2005/0162; A61F 2005/0165; A61F 2005/0167; A61F 2005/0169; A61F 2005/0197; A61F 5/0109; A61F 5/30; A61F 5/132; A61F 5/134
USPC ..... 602/16, 20, 21, 22, 23, 24, 26, 27, 28; 601/5, 34
See application file for complete search history.

(56) References Cited

U.S. PATENT DOCUMENTS

| | | | | |
|---|---|---|---|---|
| 4,922,630 | A * | 5/1990 | Robinson | A43B 5/00 36/89 |
| 5,230,696 | A | 7/1993 | Silver et al. | |
| 5,792,087 | A * | 8/1998 | Pringle | A61F 5/0127 602/23 |
| 7,081,102 | B1 * | 7/2006 | Koetter | A61F 5/013 128/878 |
| 2004/0102723 | A1 | 5/2004 | Horst | |
| 2007/0161934 | A1 * | 7/2007 | Lan | A61F 5/0127 602/23 |
| 2008/0269656 | A1 * | 10/2008 | Arnold | A43B 7/00 602/28 |

FOREIGN PATENT DOCUMENTS

| | | | | |
|---|---|---|---|---|
| EP | 2 923 686 | A2 | 9/2015 | |
| EP | 2923686 | A3 | 1/2016 | |
| WO | 97/38759 | A1 | 10/1997 | |
| WO | WO-03057094 | A1 * | 7/2003 | A61F 5/0127 |
| WO | 2012/002078 | A1 | 1/2012 | |

OTHER PUBLICATIONS

International Research Report dated Oct. 12, 2017, for International Application No. PCT/EP2017/069228.
International Search Report of PCT/EP2017/069228 dated Oct. 20, 2017.

* cited by examiner

EXOSKELETON STRUCTURE THAT PROVIDES FORCE ASSISTANCE TO THE USER

CROSS REFERENCE TO RELATED APPLICATIONS

This application is a National Stage of International Application No. PCT/EP2017/069228 filed Jul. 28, 2017, claiming priority based on French Patent Application No. 1657295 filed Jul. 28, 2016, the entire contents of each of which are herein incorporated by reference.

FIELD OF THE INVENTION

The invention relates to a subassembly of an exoskeleton for providing force assistance to a user.

PRIOR ART

Exoskeletons for providing force assistance to the user are mechanical structures positioned in parallel with the human skeleton and which allow an improvement in the physical capacities of the human body.

There exist different types of exoskeletons, of which the shape and the structure depend on the tasks to be accomplished by the user. The two main types of exoskeletons are those designed for assisting the movements of the user on the one hand, and those designed for amplifying the strength capacities of the user on the other hand.

In the case of exoskeletons designed for assisting the movements of the user, the user must generally transport the structure of the exoskeleton because it is disposed on his body, which has the consequence of limiting the freedom of movement of the user and of generating an additional load and associated fatigue.

In order to relieve the user, exoskeleton structures are known in which a portion of the mass of the exoskeleton is transferred to the ground via plates disposed below the feet of the user and connected to the rest of the structure.

In these structures, the feet of the user are not in contact with the ground, which makes the structure uncomfortable.

Moreover, due to the presence of the plates, the mobility of the user is necessarily reduced. In fact, to ensure transfer of the mass of the exoskeleton to the ground, these structures generally do not fully allow the rotation or the prono-supination of the ankle of the user.

This has the consequence that this type of structure does not allow obtaining support on the ground in all phases of walking and/or in all types of terrain, particularly when the user is walking on ground that is sloping or irregular.

SUMMARY OF THE INVENTION

One goal of the invention is to propose a solution for relieving the user of the loads which he carries, whether the load generated by the structure of the exoskeleton itself, by external elements which can be associated with the structure of the exoskeleton (a backpack for example) or the weight of the user himself, while having better comfort and better mobility.

This aim is attained within the scope of the present invention thanks to an exoskeleton subassembly comprising:

- a first exoskeleton part,
- a second exoskeleton part,
- a connecting assembly connecting the first exoskeleton part to the second exoskeleton part, the connecting assembly comprising a guide fixedly mounted with respect to one of the first part and of the second part, and a pin fixedly mounted with respect to the other of the first part and of the second part, the pin being slidably mounted inside the guide between a first end position and a second end position.

The connecting assembly further comprises a limiting device arranged to allow rotation of the pin with respect to the guide when the pin is in the first end position, and to oppose rotation of the pin with respect to the guide when the pin is in the second end position.

The limiting device comprises an elastic element with which the first exoskeleton part engages when the pin is in the second end position, the elastic element exerting on the first exoskeleton part an elastic return force tending to oppose relative rotation between the first exoskeleton part and the second exoskeleton part.

Such an exoskeleton subassembly can be used so that:

- when the subassembly is not loaded, the pin is located in the first end position, the limiting device allowing relative rotation between the first exoskeleton part and the second exoskeleton part, thus allowing freedom of movement between the two parts,
- when the subassembly is loaded, the pin is located in the second end position, the limiting device opposing relative rotation between the first exoskeleton part and the second exoskeleton part, thus allowing a transfer of force between the first part and the second part.

When the pin is in the second position, the limiting device opposes relative rotation between the first part and the second part via the elastic part. For this reason, the limiting device allows a certain rotation between the first part and the second part, while generating a return force opposing this movement so as to ensure the transfer of force between the first part and the second part. This feature procures better comfort for the user during his movements.

One of the first exoskeleton part and of the second exoskeleton part is for example a part capable of being attached to a leg of the user and the other of the first exoskeleton part and of the second exoskeleton part is a part capable of being attached to the foot of the user.

The connecting assembly between the two exoskeleton parts is then placed in parallel with the ankle joint of the user.

During the walking cycle, the pin is displaced alternatively from the first position to the second position (when the user places the foot on the ground: loading) and from the second position to the first position (when the user raises the foot from the ground: unloading).

When the pin is located in the first end position (foot raised), the connecting assembly allows rotation of the second part with respect to the first part caused by a movement of the foot with respect to the leg of the user.

When the pin is located in the second end position (foot resting on the ground), the connecting assembly opposes the rotation of the second part with respect to the first part, so as to transfer the load supported by the exoskeleton to the ground and to support all or part of the torque exerted on the ankle of the user.

In a first embodiment of the assembly, the connecting assembly is disposed between the first exoskeleton part and the second exoskeleton part so that, when the pin is located in the first end position, the connecting assembly allows rotation of the second exoskeleton part with respect to the first exoskeleton part caused by a flexure/extension movement of the foot with respect to the leg.

In a second embodiment, the connecting assembly is disposed between the first exoskeleton part and the second exoskeleton part so that, when the pin is located in the first end position, the connecting assembly allows rotation of the second exoskeleton part with respect to the first exoskeleton part caused by an eversion/inversion movement of the foot with respect to the leg.

The exoskeleton subassembly can further have the following features:

- the guide comprises an oblong orifice provided in the first exoskeleton part,
- the pin has an axially symmetrical shape,
- the elastic element is disposed between the two exoskeleton parts,
- when the pin is in the second end position, the elastic element exerts a return force tending to oppose relative rotation between the first exoskeleton part and the second exoskeleton part, both in a first direction of rotation and in a second direction of rotation, opposite to the first direction of rotation,
- the elastic element is fixedly mounted with respect to the second exoskeleton part,
- the elastic element is a block made of elastic material,
- the first exoskeleton part has a protrusion, and the elastic element has a recess in which the protrusion is received when the pin is in the second end position,
- the protrusion has a shape complementary to the shape of the recess,
- the protrusion has a general shape of a point and the recess has a general V shape,
- the first exoskeleton part has a cutout, and the elastic element has a bulge capable of being received in the cutout when the pin is in the second end position,
- the elastic element has one or more portion(s) capable of being compressed between the two exoskeleton parts when the pin is in the second end position, in the event of relative rotation between the first exoskeleton part and the second exoskeleton part,
- the elastic element comprises a spring arranged to exert a return force on the other exoskeleton part, the return force exerted by the spring opposing to the rotation of the pin with respect to the guide when the pin is in the second end position,
- the spring comprises one or more flexible blade(s), each blade having one end attached to one of the two exoskeleton parts, the blade(s) being disposed so that the rotation of the pin with respect to the guide has the effect that the other exoskeleton part loads the blade(s) in flexure.

The invention further applies to an exoskeleton structure comprising a subassembly as defined previously.

PRESENTATION OF THE DRAWINGS

Figure 2:
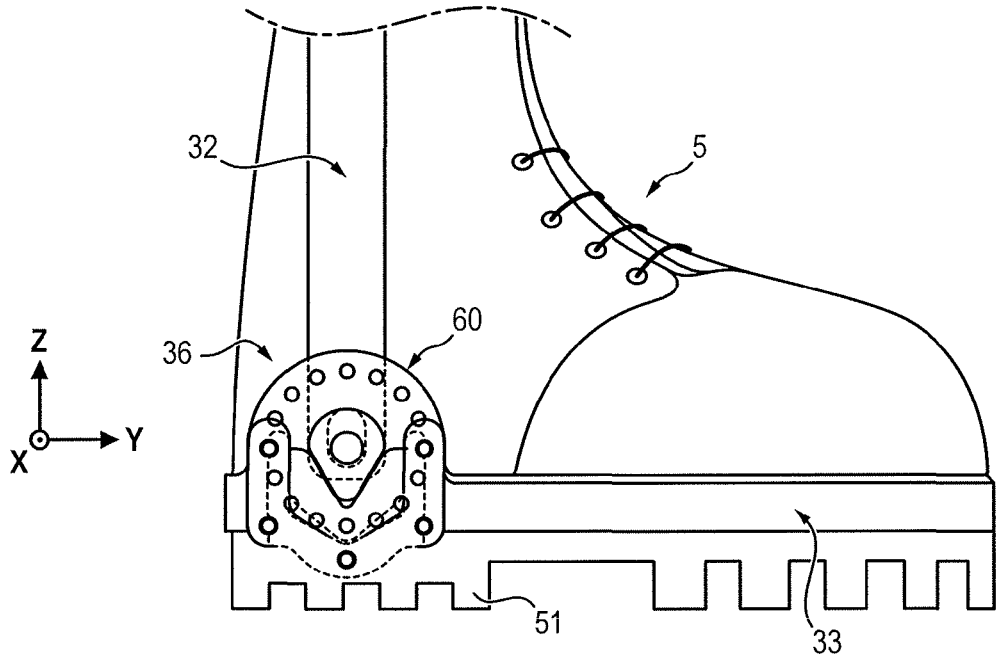
Figure 3:
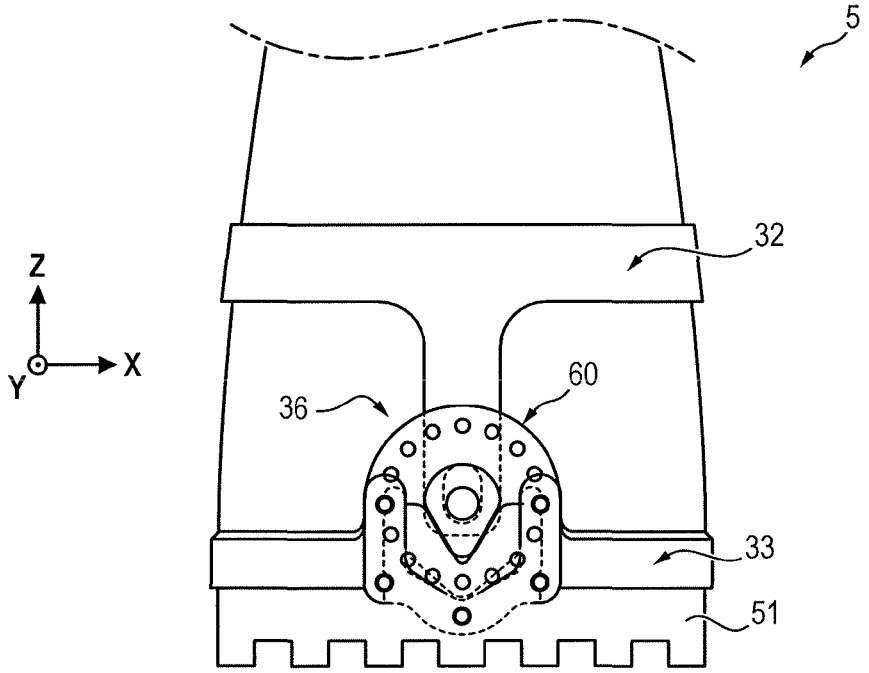
Figure 4A:
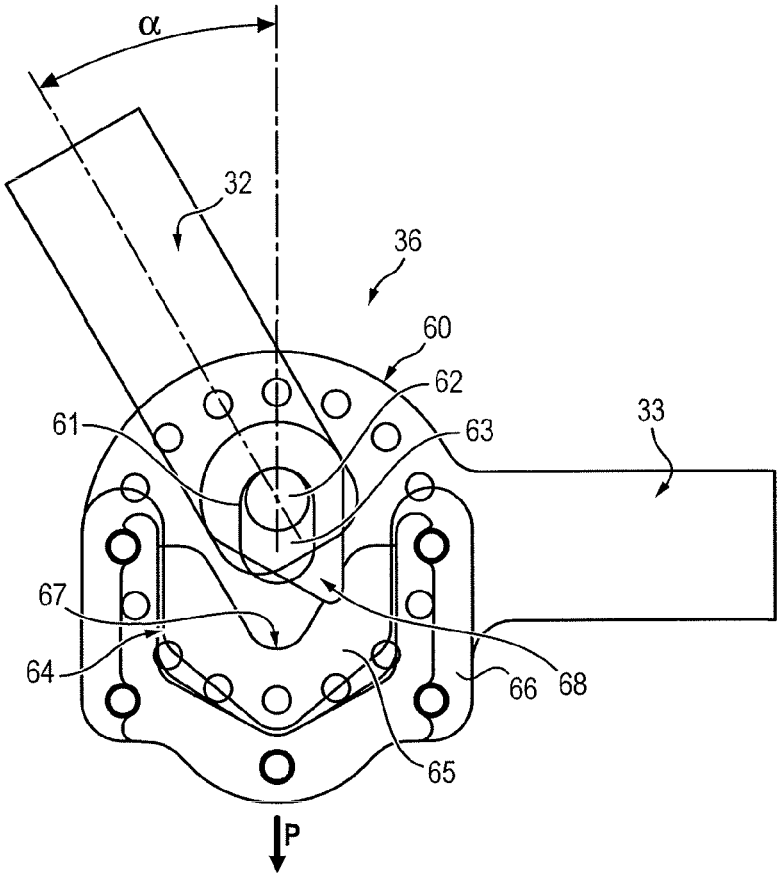
Figure 4B:
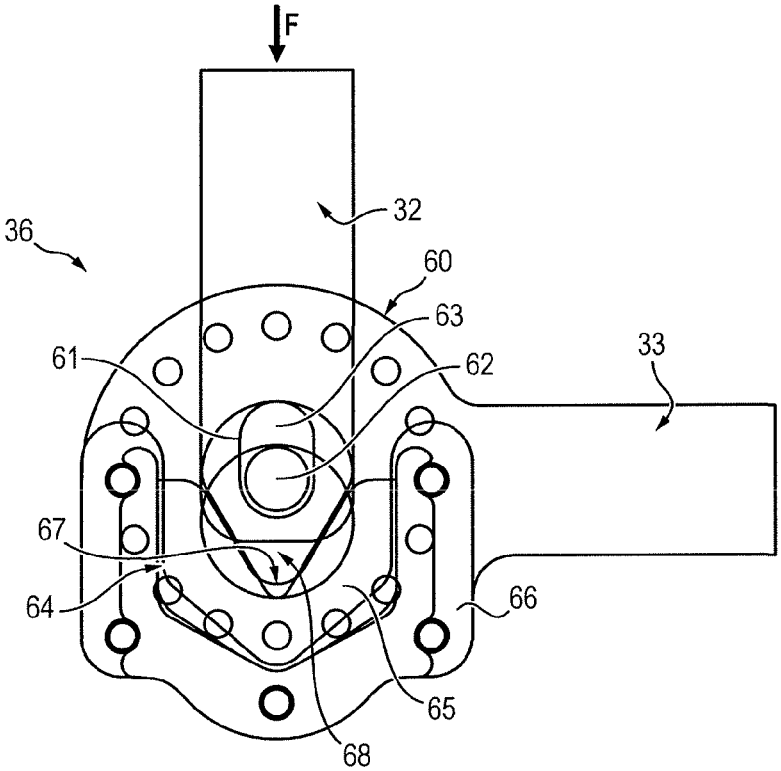
Figure 5A:
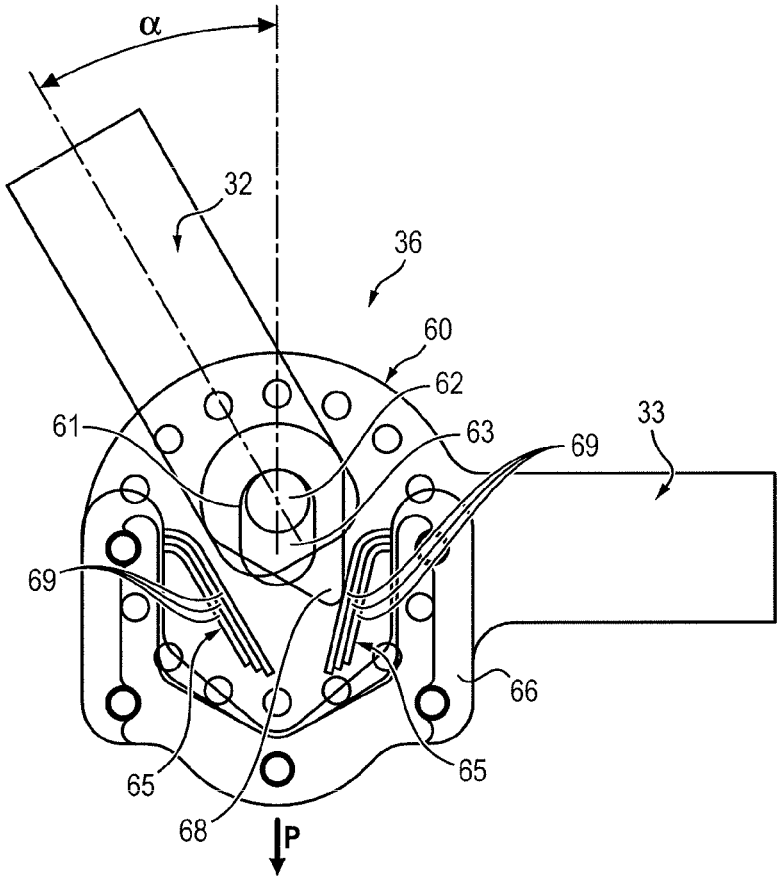
Figure 5B:
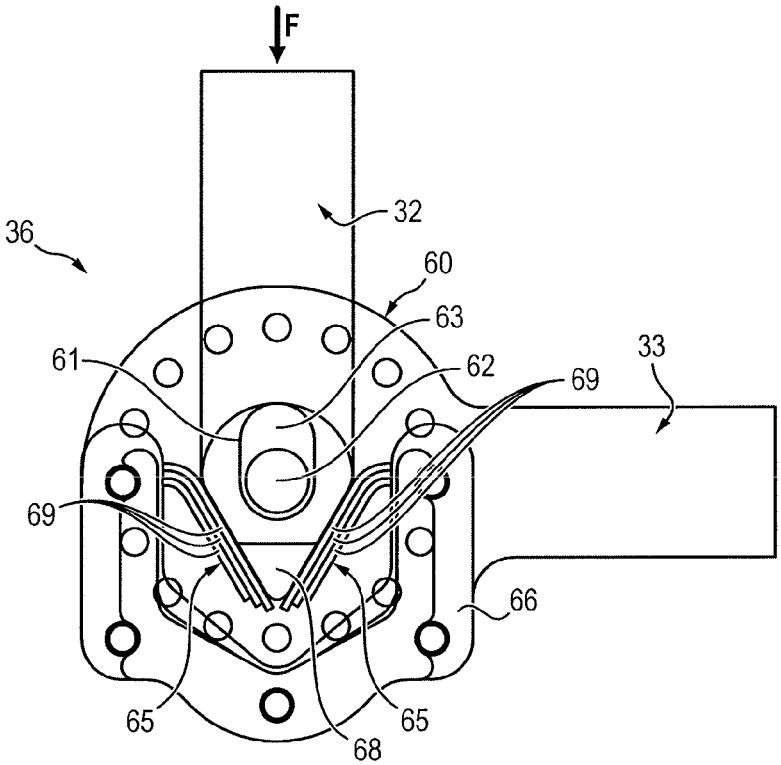
Figure 6:
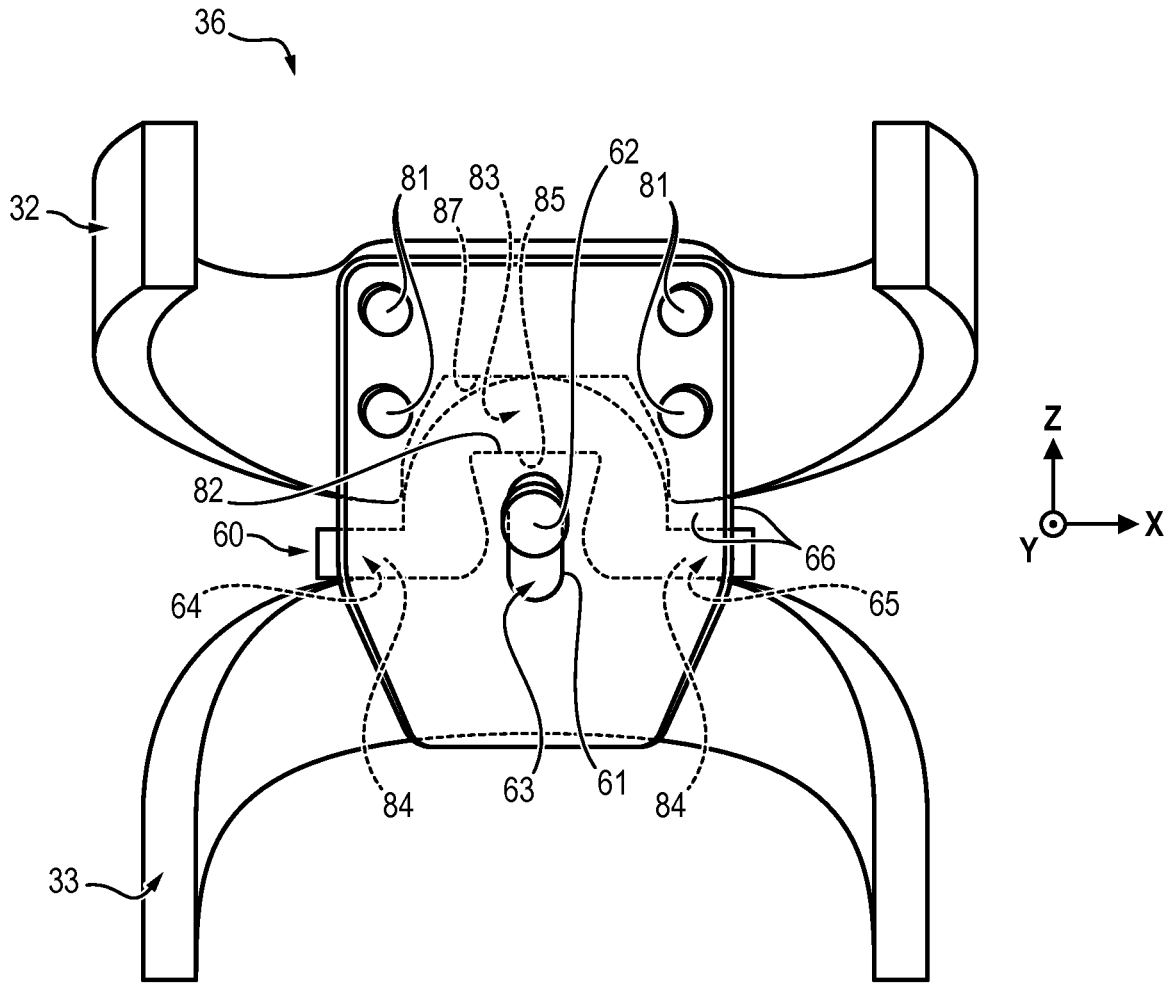
Figure 7A:
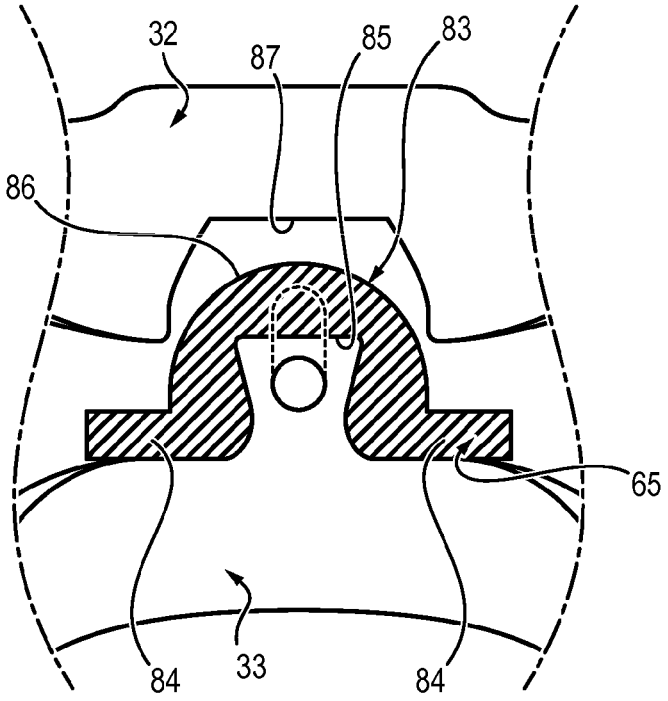
Figure 7B:
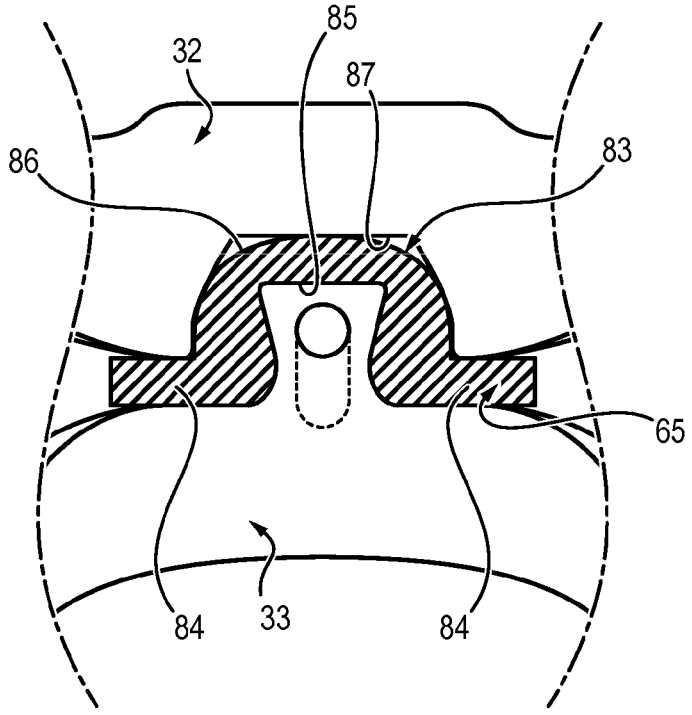

Other features and advantages will be revealed by the description that follows, which is purely illustrative and not limiting and must be read with reference to the appended figures, among which:

FIG. 1 shows schematically, in front view, a user equipped with an exoskeleton structure, FIG. 2 shows schematically a subassembly of the exoskeleton structure conforming to a first embodiment of the invention, FIG. 3 shows schematically a subassembly of the exoskeleton structure conforming to the second embodiment of the invention, FIGS. 4A and 4B show schematically a first example of a connecting assembly when the pin is located in the first end position and when the pin is located in the second end position, respectively, FIGS. 5A and 5B show schematically a second example of a connecting assembly when the pin is located in the first end position and when the pin is located in the second end position, respectively, FIG. 6 shows schematically a third example of a connecting assembly, FIGS. 7A and 7B show schematically the third example of a connecting assembly when a pin is located in the first end position and when the pin is located in the second end position, respectively.

DETAILED DESCRIPTION OF AN EMBODIMENT

In FIG. 1, the exoskeleton structure 1 shown comprises a lumbar belt 2, a first mechanical assembly 3 and a second mechanical assembly 4.

The lumbar belt 2 is capable of surrounding the lower trunk of the user. The first mechanical assembly 3 is capable of being connected to a first lower member of the user (right leg) to assist the movement of the first lower member during walking or running. The second mechanical assembly 4 is capable of being connected to a second lower member (left leg) to assist the movement of the second lower member during walking or running. The first mechanical assembly 3 and the second mechanical assembly 4 are each connected to the lumbar belt 2.

The first mechanical assembly 3 comprises a first femoral part 31, a first shin part 32, and a first foot part 33.

The first femoral part 31 comprises a first femoral segment 311 designed to extend along a first thigh (right thigh) of the user, and attachment straps 312 capable of surrounding the first thigh of the user for attaching the femoral segment 311 to the first thigh.

The first shin part 32 comprises a first shin segment 321 designed to extend along a first calf (right calf) of the user and attachment straps 322 capable of surrounding the first calf of the user, to attach the shin segment 321 to the first calf.

The first foot part 33 is attached to a first shoe 5 of the user, for example to a sole 51 of the shoe 5. The first foot part 33 can be attached to the sole 51 by means of screws.

The first femoral segment 311 comprises a first end 313 connected to the lumbar belt 2 by means of a first hip joint 34 and a second end 314 connected to the first shin segment 321 by means of a second knee joint 35.

The first shin segment 321 comprises a first end 323 connected to the first femoral segment 311 by the first knee joint 35 and a second end 324 connected to the first foot part 33 by means of a first ankle joint 36.

The second mechanical assembly 4 is symmetrical with the first mechanical assembly 3.

The second mechanical assembly 4 also comprises a second femoral part 41, a second shin part 42 and a second foot part 43.

The second femoral part 41 comprises a second femoral segment 411 designed to extend along a second thigh (left thigh) of the user and attachment straps 412 capable of surrounding the second thigh of the user to attach the femoral segment 411 to the second thigh.

The second shin part 42 comprises a second shin segment 421 designed to extend along a second calf (left calf) of the user and attachment straps 422 capable of surrounding the second calf of the user to attach the second shin segment 421 to the second calf.

The second foot part 43 is attached to a second shoe 7 of the user, for example to a sole 71 of the shoe 7. The second foot part 43 can be attached to the sole 71 by means of screws.

The second femoral segment 411 comprises a first end 413 connected to the lumbar belt 2 by means of a second hip joint 44 and a second end 414 connected to the second shin segment 421 by means of a second knee joint 45.

The second shin segment 421 comprises a first end 423 connected to the second femoral segment 411 by the second knee joint 45 and a second end 424 connected to the second foot part 43 by means of a second ankle joint 46.

The hip joints 34, 44 and the knee joints 35, 45 can comprise actuators allowing assistance to the user during a flexural or extensional movement of the hip or of the knee.

FIG. 2 shows in more detail an ankle joint 36 conforming to a first embodiment of the invention.

In this first embodiment, the ankle joint 36 is designed to allow a flexural/extensional movement of the foot with respect to the leg of the user.

In other words, the ankle joint 36 allows a rotation of the shin part 32 with respect to the foot part 33 around an axis of rotation X, parallel to a flexural/extensional axis of the ankle, when the shin part 32 is attached to the leg and the foot part 33 is attached to the foot of the user.

FIG. 3 shows in more detail an ankle joint 36 conforming to a second embodiment of the invention.

In this second embodiment, the ankle joint 36 is designed to allow an eversion/inversion movement of the foot of the user with respect to the leg.

In other words, the ankle joint 36 allows rotation of the shin part 32 with respect to the foot part 33 around an axis of rotation Y, parallel to an eversion/inversion axis of the ankle when the tibial part 32 is attached to the leg and the foot part 33 is attached to the foot of the user.

FIGS. 4A and 4B illustrate in more detail the first ankle joint 36 conforming to a first exemplary embodiment. It should be noted that the second ankle joint 46 is identical to the first ankle joint 36.

The ankle joint 36 comprises a connecting assembly 60 connecting the shin part 32 to a foot part 33.

The connecting assembly 60 comprises a guide 61 fixedly mounted with respect to the shin part 32, and a pin 62 fixedly mounted with respect to the foot part 33. The pin 62 is slidably mounted inside the guide 61 between a first end position (illustrated in FIG. 4A) and a second end position (illustrated in FIG. 4B).

The guide 61 comprises an oblong orifice 63 provided in the shin part 32. The pin 62 extends through the oblong orifice 63. The pin 62 has an axially symmetrical shape, having an axis of revolution. In this manner, the pin 62 can both be displaced in translation with respect to the guide 61, and pivot with respect to the guide 61 along an axis of rotation X (equal to the axis of revolution of the pin) and perpendicular to the direction Z of translation of the pin 62 with respect to the guide 61. The rotation and translation of the pin 62 with respect to the guide 61 are independent.

The axis of rotation X is an axis of rotation parallel to the flexural/extensional axis of the ankle in conformity with the first embodiment illustrated in FIG. 2.

However, the axis of rotation could also be the axis of rotation Y, parallel to the eversion/inversion axis of the ankle in conformity with the second embodiment illustrated in FIG. 3.

The connecting assembly 60 further comprises a limiting device 64 arranged to allow rotation of the pin 62 with respect to the guide 61 when the pin 62 is in the first end position (FIG. 4A), and limit the rotation of the pin 62 with respect to the guide 61 when the pin 62 is in the second end position (FIG. 4B).

The limiting device 64 comprises an elastic element 65 fixedly mounted on the foot part 33. The elastic element 65 is fixedly mounted on the foot part 33 for example by means of plates 66 disposed on either side of the elastic element 65 and screwed to the foot part 33. The elastic element 65 is kept clamped between the two plates 66.

The elastic element 65 is for example a block made of elastic material, such as rubber.

The elastic element 65 comprises a recess 67 having a general V shape. The recess 67 has an opening angle comprised between 20 and 150 degrees, preferably between 30 and 40 degrees.

The limiting device 60 further comprises a protrusion 68 fixedly mounted to the shin part 32. The protrusion 68 can be fixedly mounted to the shin part 32 by means of the pin 62.

In the first example illustrated in FIGS. 4A and 4B, the protrusion 68 has a shape complementary to the shape of the recess 67. More precisely, the protrusion 68 has the general shape of a point.

The protrusion 68 is capable of being engaged with the elastic element 67 when the pin 62 is in the second end position (FIG. 4B).

More precisely, when the pin 62 is located in the second end position (FIG. 4B), the protrusion 68 is received in the recess 67 of the elastic element 65, which has the effect of limiting the rotation of the pin 62 with respect to the guide 61.

When the user is walking, the operation of the ankle joint 36 is the following.

During the walking cycle, the foot of the user passes successively from a support phase (i.e. a phase during which the foot of the user is supported on the ground) to an oscillation phase (i.e. a phase during which the foot of the user is no longer in contact with the ground).

During the support phase, the load exerted on the exoskeleton generates on the mechanical assembly 3 a force F which has the effect of loading the shin part 32 downward, and consequently loading the pin 62 of the ankle joint 36 toward the second end position (FIG. 4B).

In this second end position, the rotation of the pin 62 with respect to the guide 61 is limited. In fact, the protrusion 68 is engaged with the elastic element 65. The elastic element 65 then exerts on the shin part 32 an elastic return force opposing relative rotation between the shin part 32 and the foot part 33, both in the first direction of rotation and in the second direction of rotation opposite to the first direction of rotation. By limiting the movement of the protrusion 68, the elastic element 65 limits the rotation clearance of the shin part 32 with respect to the foot part 33.

In this position, the load exerted on the exoskeleton is transferred from the shin part 32 to the foot part 33. This load is transferred from the foot part 33 to the shoe 5, and therefore to the ground.

During the oscillation phase, the load exerted on the exoskeleton is transferred mainly to the ground via the other mechanical assembly 4. Furthermore, the shoe 5 is no longer in contact with the ground and the weight P of the shoe 5 loads the foot part 33 downward. The weight P consequently loads the pin 62 of the ankle joint 46 toward the first end position (FIG. 4A).

In this first end position, the protrusion 68 is no longer engaged with the elastic element 65. The elastic element 65 therefore no longer limits the rotation clearance of the shin part 32 with respect to the foot part 33. The limiting device 60 allows rotation of the foot part 33 with respect to the shin part 32, thus allowing freedom of movement to the user.

In this first position, no load is transferred from the shin part 32 to the foot part 33.

FIGS. 5A and 5B illustrate in more detail the first ankle joint 36 in conformity with a second exemplary embodiment.

In this second example, the limiting device 64 comprises two elastic elements 65 fixedly mounted on the foot part 33. Each elastic element is a leaf spring.

The leaf springs are disposed on either side of the protrusion 68, forming a V.

Each leaf spring 65 comprises a plurality of flexible blades 69 arranged parallel to one another. The blades can be made of metal, such as steel for example.

Each blade 69 has a first end attached to the foot part 33 and a second free end. The flexible blades 69 have different lengths so as to procure stepped flexibility for the spring. The blades 69 of the same spring 65 are arranged side by side, from the largest to the smallest, so that when the pin 62 is in the second end position (FIG. 5B), the protrusion 68 enters into contact with the longer blades.

More precisely, when the pin 62 is located in the second end position (FIG. 5B), the protrusion 68 is received between the two elastic elements 65, which has the effect of loading the blades 69 in flexure.

When they are loaded in flexure, the blades 69 exert on the protrusion 68 an elastic return force tending to oppose a rotation of the pin 62 with respect to the guide 61.

When the user is walking, the operation of the ankle joint 36 is the following.

During the support phase, the load exerted on the exoskeleton generates on the mechanical assembly 3 a force F which has the effect of loading the shin part 32 downward, and consequently loading the pin 62 of the ankle joint 36 toward the second end position (FIG. 5B).

In this second end position, rotation of the pin 62 with respect to the guide 61 is possible but it is limited. In fact, the protrusion 68 is in contact with the two elastic elements 65. By opposing the movement of the protrusion 68, the elastic elements 65 limit the rotation clearance of the shin part 32 with respect to the foot part 33.

In this position, the load exerted on the exoskeleton is transferred from the shin part 32 to the foot part 33. This load is transferred from the foot part 33 to the shoe 5 and therefore to the ground.

During the oscillation phase, the load exerted on the exoskeleton is transferred mainly to the ground via the other mechanical assembly 4. Furthermore, the shoe 5 is no longer in contact with the ground and the weight P of the shoe 5 loads the foot part 33 downward. The weight P consequently loads the pin 62 of the ankle joint 46 toward the first end position (FIG. 5A).

In this first end position, the protrusion 68 is no longer in contact with the elastic elements 65. The elastic elements 65 therefore no longer oppose rotation of the shin part 32 with respect to the foot part 33. The limiting device 60 allows rotation of the foot part 33 with respect to the shin part 32, thus allowing freedom of movement to the user.

FIG. 6 illustrates the first ankle joint 36 in conformity with a third exemplary embodiment. It should be noted that the second ankle joint 46 is identical with the first ankle joint 36.

The ankle joint 36 comprises a connecting assembly 60 connecting the shin part 32 to the foot part 33.

The connecting assembly 60 comprises a guide 61 fixedly mounted with respect to the shin part 32, and a pin 62 fixedly mounted with respect to the foot part 33. The pin 62 is slidably mounted inside the guide 61 between a first end position (illustrated in FIG. 7A) and a second end position (illustrated in FIG. 7B).

To this end, the connecting assembly 60 comprises two plates 66, disposed on either side of the shin part 32. The two plates 66 are attached to the shin part 32 by means of attachment screws 81 passing through the plates 66 and the shin part 32.

The guide 61 comprises an oblong orifice 63 provided in one of the plates 66 or preferably in both plates 66.

The pin 62 is attached to a strip 82 of the foot part 33 extending between the two plates 66.

The pin 62 extends through the oblong orifice 63. The pin 62 has an axially symmetrical shape having an axis of revolution. In this manner, the pin 62 can both be moved in translation with respect to the guide 61, and pivot with respect to the guide 61 along an axis of rotation Y (equal to the axis of revolution of the pin) and perpendicular to the direction Z of translation of the pin 62 with respect to the guide 61.

The axis of rotation Y is an axis of rotation parallel to the eversion/inversion axis of the ankle in conformity with the second embodiment illustrated in FIG. 3.

However, the axis of rotation could also be the axis of rotation X, parallel to the flexure/extension axis of the ankle in conformity to the first embodiment illustrated in FIG. 2.

The connecting assembly 60 comprises a limiting device 64 arranged to allow rotation of the pin 62 with respect to the guide 61 when the pin 62 is in the first end position (FIG. 7A), and limit the rotation of the pin 62 with respect to the guide 61 when the pin 62 is in the second end position (FIG. 7B).

The limiting device 64 comprises an elastic element 65 disposed between the shin part 32 and the foot part 33. In the example illustrated in FIG. 6, the elastic element 65 is fixedly mounted on the foot part 33. To this end, the elastic element 65 has a shape which molds itself to the strip 82 of the foot part.

The elastic element 65 is retained between the shin part 32 and the foot part 33 by means of plates 66 disposed on either side of the elastic element 65 and screwed to the shin part 32. The elastic element 65 can nevertheless slide between the two plates 66.

The elastic element 65 is for example a block made of elastic material, such as rubber.

The elastic element 65 comprises a central portion 83 and two lateral portion 84. The central portion 83 has a generally arched shape, while each lateral portion 84 has a generally straight shape, so as to confer on the elastic element 65 a generally Ω shape.

The central portion 83 of the elastic element 65 thus forms a recess 85 oriented toward the foot portion 33. The recess 84 receives the strip 82 of the foot part 33.

The central portion 83 of the elastic element 65 further forms a bulge 86 of generally rounded shape, oriented toward the shin part 32.

The shin part 32 further comprises a recess 87 positioned facing the bulge 86 and capable of receiving the bulge 86 of the elastic element 65. In this manner, the shin part 32 is capable of being engaged with the elastic element 65, when the bulge 86 of the elastic element is received in the recess 87 (FIG. 7B).

More precisely, when the pin 62 is located in the second end position (FIG. 7B), the bulge 86 of the elastic element 65 is received in the recess 87 of the shin part 32, which has the effect of compressing the central portion 83 of the elastic element 65 between the shin part 32 and the foot part 33 and to limit the rotation of the pin 62 with respect to the guide 61.

When the user is walking, the operation of the ankle joint 36 is the following.

During the walking cycle, the foot of the user passes successively from a support phase (i.e. a phase during which the foot of the user is resting on the ground) to an oscillation phase (i.e. a phase during which the foot of the user is no longer in contact with the ground).

During the support phase, the load exerted on the exoskeleton generates on the mechanical assembly 3 a force F which has the effect of loading the shin part 32 downward, and consequently loading the pin 62 of the ankle joint 36 toward the second end position (FIG. 7B).

In this second end position, rotation of the pin 62 with respect to the guide 61 is possible, but it is limited. In fact, the bulge 87 of the shin part 32 is engaged with the elastic element 65. The elastic element 65 then exerts on the shin part 32 an elastic return force opposing relative rotation between the shin part 32 and the foot part 33, both in a first direction of rotation as in a second direction of rotation opposite to the first direction of rotation.

In addition, the elastic element 65 is compressed between the shin part 32 and the foot part 33. In this position, the shin part 32 can turn slightly with respect to the foot part around the axis Y. However, the two lateral portions 84 of the elastic element 65 limit the rotation clearance of the shin part with respect to the foot part. In fact, by turning, the shin part 32 comes into contact with the lateral portions 84, these lateral portions 84 exerting a return force on the shin part 32 tending to opposed the rotation of the shin part 32 with respect to the foot part 33.

In this second end position, the load exerted on the exoskeleton is transferred from the shin part 32 to the foot part 33. This load is transferred from the foot part 33 to the shoe 5 and therefore to the ground.

During the oscillation phase, the load exerted on the exoskeleton is transferred mainly to the ground via the other mechanical assembly 4. Furthermore, the shoe 5 is no longer in contact with the ground and the weight P of the shoe 5 loads the foot part 33 downward. The weight P consequently loads the pin 62 of the ankle joint 46 toward the first end position (FIG. 7A).

In this first end position, the recess 87 of the shin part 32 is no longer engaged with the elastic element 65. The elastic element 65 therefore no longer limits the rotation clearance of the shin part 32 with respect to the foot part 33. The limiting device 60 allows free rotation of the foot part 33 with respect to the shin part 32, thus allowing freedom of movement to the user.

In this first position, no load is transferred from the shin part 32 to the foot part 33.

The invention claimed is:

1. An exoskeleton subassembly comprising:

a first exoskeleton part, a second exoskeleton part, a connecting assembly connecting the first exoskeleton part to the second exoskeleton part, the connecting assembly comprising a guide fixedly mounted with respect to one of the first exoskeleton part and the second exoskeleton part, and a pin fixedly mounted with respect to the other of the first exoskeleton part and the second exoskeleton part, the pin being slidably mounted inside the guide between a first end position and a second end position, wherein the connecting assembly further comprises a limiting device arranged to allow rotation of the pin with respect to the guide when the pin is in the first end position, and to oppose rotation of the pin with respect to the guide when the pin is in the second end position, the limiting device comprising an elastic element with which the first exoskeleton part engages when the pin is in the second end position, the elastic element exerting on the first exoskeleton part an elastic return force tending to oppose relative rotation between the first exoskeleton part and the second exoskeleton part both in a first direction of rotation and in a second direction of rotation, opposite to the first direction of rotation, wherein the first exoskeleton part has a protrusion, and the elastic element has a recess in which the protrusion is received when the pin is in the second end position.

2. The exoskeleton subassembly according to claim 1, wherein the guide comprises an oblong orifice provided in the first exoskeleton part.

3. The exoskeleton subassembly according to claim 1, wherein the pin has an axially symmetrical shape.

4. The subassembly according to claim 1, wherein the elastic element is disposed between the first exoskeleton part and the second exoskeleton part.

5. The exoskeleton subassembly according to claim 1, wherein the elastic element is fixedly mounted with respect to the second exoskeleton part.

6. The exoskeleton subassembly according to claim 1, wherein the elastic element is a block made of elastic material.

7. The exoskeleton subassembly according to claim 1, wherein the protrusion has a shape complementary to a shape of the recess.

8. The exoskeleton subassembly according to claim 1, wherein the protrusion has a general shape of a point and the recess has a general V shape.

9. The exoskeleton subassembly according to claim 1, wherein the first exoskeleton part has a cutout, and the elastic element has a bulge capable of being received in the cutout when the pin is in the second end position.

10. The exoskeleton subassembly according to claim 1, wherein the elastic element has one or more portions that are compressed between the first exoskeleton part and the second exoskeleton part when the pin is in the second end position and relative rotation between the first exoskeleton part and the second exoskeleton part occurs.

11. The exoskeleton subassembly according to claim 1, wherein the elastic element comprises a spring arranged to exert a return force on the other exoskeleton part, the return force exerted by the spring opposing the rotation of the pin with respect to the guide when the pin is in the second end position.

12. The exoskeleton subassembly according to claim 11, wherein the spring comprises one or more flexible blades, each blade having one end attached to one of the first exoskeleton part and the second exoskeleton part, the one or more flexible blades being disposed so that the rotation of the pin with respect to the guide causes the other one of the first exoskeleton part and the second exoskeleton part that is not attached to the blade to load the one or more flexible blades in flexure.

13. The exoskeleton subassembly according to claim 1, wherein one of the first exoskeleton part and of the second exoskeleton part is a part capable of being attached to a leg of a user and the other of the first exoskeleton part and of the second exoskeleton part is a part capable of being attached to a foot of the user, the connecting assembly allowing relative rotation between the second exoskeleton part and the first exoskeleton part caused by an eversion or inversion movement of the foot with respect to the leg or by a flexural or extension movement of the foot with respect to the leg.

14. An exoskeleton structure comprising the exoskeleton subassembly according to claim 1.

15. The exoskeleton subassembly according to claim 1 configured:

to load the pin toward the second end position during a support phase of a walking of a user using the exoskeleton subassembly and to load the pin toward the first end position during an oscillation phase of the walking.

* * * * *